US006277803B1

(12) United States Patent
Tarng et al.

(10) Patent No.: US 6,277,803 B1
(45) Date of Patent: Aug. 21, 2001

(54) THICKENED CLEANING COMPOSITION

(75) Inventors: Jiashi Tarng, Cranbury; Ammanuel Mehreteab, Piscataway, both of NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 09/757,209

(22) Filed: Jan. 9, 2001

Related U.S. Application Data

(63) Continuation-in-part of application No. 09/605,068, filed on Jun. 28, 2000, now abandoned.

(51) Int. Cl.[7] ..... C11D 1/14; C11D 1/22; C11D 1/75

(52) U.S. Cl. ..... 510/237; 510/428; 510/433; 510/503

(58) Field of Search ..... 510/237, 428, 510/433, 503

(56) References Cited

U.S. PATENT DOCUMENTS

| | | | | |
|---|---|---|---|---|
| 5,922,672 | * | 7/1999 | Stringer et al. | 510/503 |
| 6,051,543 | * | 4/2000 | Tarng et al. | 510/248 |
| 6,107,263 | * | 8/2000 | D'Ambrogio et al. | 510/237 |

* cited by examiner

*Primary Examiner*—Gregory Delcotto
(74) *Attorney, Agent, or Firm*—Richard E. Nanafeldt

(57) ABSTRACT

A clear thickened cleaning composition includes an alpha olefin sulfonate surfactant, a linear alkyl benzene sulfonate surfactant, an amine oxide surfactant, an alkali metal salt and/or an alkaline earth metal salt and water.

2 Claims, No Drawings

THICKENED CLEANING COMPOSITION

RELATED APPLICATION

This application is a continuation in part application of U.S. Ser. No. 9/605,068 filed Jun. 28, 2000, now abandoned.

FIELD OF THE INVENTION

The present invention relates to a thickened cleaning composition comprising an alpha olefin sulfonate, surfactant, a linear alkyl benzene sulfonate surfactant, an amine oxide surfactant, a metal salt and water, wherein the composition has a Brookfield viscosity at 25° C., #4 spindle, 20 rpms of at least 2,000 cps which when diluted at a 4:1 weight ratio with water has a Brookfield viscosity of about 40 to about 400 cps at 25° C., #4 spindle, 20 rpms and the composition.

BACKGROUND OF THE INVENTION

In recent years all-purpose liquid detergents have become widely accepted for cleaning hard surfaces, e.g., painted woodwork and panels, tiled walls, wash bowls, bathtubs, linoleum or tile floors, washable wall paper, etc. Such all-purpose liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surface or all-purpose liquid detergent composition where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of about 25 to about 800 Å in a continuous aqueous phase.

In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616—Herbots et al; European Patent Application EP 0160762—Johnston et al; and U.S. Pat. No. 4,561,991—Herbots et al. Each of these patent disclosures also teaches using at least 5% by weight of grease-removal solvent.

It also is known from British Patent Application GB 2144763A to Herbots et al, published Mar. 13, 1985, that magnesium salts enhance grease-removal performance of organic grease-removal solvents, such as the terpenes, in o/w microemulsion liquid detergent compositions. The compositions of this invention described by Herbots et al. require at least 5% of the mixture of grease-removal solvent and magnesium salt and preferably at least 5% of solvent (which may be a mixture of water-immiscible non-polar solvent with a sparingly soluble slightly polar solvent) and at least 0.1% magnesium salt.

However, since the amount of water immiscible and sparingly soluble components which can be present in an o/w microemulsion, with low total active ingredients without impairing the stability of the microemulsion is rather limited (for example, up to about 18% by weight of the aqueous phase), the presence of such high quantities of grease-removal solvent tend to reduce the total amount of greasy or oily soils which can be taken up by and into the microemulsion without causing phase separation.

The present invention relates to novel light duty liquid detergent compositions having an apparent viscosity at 3 times dilution in deionized water at shear rate of 20 $sec^{-1}$ at 25° C. of about 300 to about 700 cps and at 4 times dilution in deionized water at a shear rate of 20 $sec^{-1}$ at 25° C. of about 150 to about 350 cps and high foaming properties which comprises a sulfonate surfactant, a sodium salt of an ethoxylated alkyl ether sulfate surfactant, a salting-in salt, a salting-out salt and water.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

The prior art also discloses detergent compositions containing all nonionic surfactants as shown in U.S. Pat. Nos. 4,154,706 and 4,329,336 wherein the shampoo compositions contain a plurality of particular nonionic surfactants in order to effect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,671,895 teaches a liquid detergent composition containing an alcohol sulfate surfactant, a nonionic surfactant, a paraffin sulfonate surfactant, an alkyl ether sulfate surfactant and water.

U.S. Pat. No. 4,450,091 discloses high viscosity shampoo compositions containing a blend of an amphoteric betaine surfactant, a polyoxybutylene polyoxyethylene nonionic detergent, an anionic surfactant, a fatty acid alkanolamide and a polyoxyalkylene glycol fatty ester. But, none of the exemplified compositions contains an active ingredient mixture wherein the nonionic detergent is present in major proportion, probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monethanolamide foam stabilizer.

However, none of the above-cited patents discloses a liquid detergent composition having at 3 times dilution in deionized water and at an apparent viscosity at 25° C. of about 300 to about 700 cps which comprises an alkali metal salt of an alkyl benzene sulfonate surfactant, an alkali metal salt of an ethoxylated alkyl ether sulfate surfactant, a salting-in salt, a salting-out salt and water, wherein the composition does not contain any betaine surfactant, nonionic surfactant low molecular weight mono- or di-glucoside, abrasives, silicas, alkaline earth metal carbonates, alkyl glycine surfactant, cyclic imidinium surfactant, alkali metal carbonates or more than 3 wt. % of a fatty acid or its salt thereof.

SUMMARY OF THE INVENTION

This invention relates to a thickened light duty liquid composition having at 4 weight times dilution in water, a Brookfield viscosity at 25° C., #4 spindle, 20 rpms of about 40 to about 400 cps which has desirable cleaning properties together with mildness to the human skin.

An object of this invention is to provide a novel light duty liquid detergent composition having a Brookfield viscosity at 25° C., #4 spindle, 20 rpms of at least 2,000 cps and having at 4 times weight dilution in water, a Brookfield viscosity at 25° C., #4 spindle, 20 rpms of about 40 to about 400 cps which comprises an alkali metal salt of an alkyl benzene sulfonate surfactant, an alkali metal salt of an alpha olefin sulfonate surfactant, a metal salt, an amine oxide surfactant, an alkaline earth metal salt or an alkali metal salt such as an alkali metal halide or an alkaline earth metal halide and water, wherein the composition does not contain any nonionic surfactant, acetic acid, hydrotrope, betaine surfactant, glucamide surfactant, alkyl polyglucoside surfactant, silicas, abrasives, alkali metal carbonates, polymeric material, alkaline earth metal carbonates, alkyl glycine surfactant, cyclic imidinium surfactant, low molecular weight mono- or di-glucoside or more than 3 wt. % of a fatty acid or salt thereof.

Another object of this invention is to provide a novel thickened, light duty liquid detergent with desirable high foaming and cleaning properties which is mild to the human skin.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE INVENTION

The flowable concentrated light duty liquid compositions of the instant invention having a Brookfield viscosity at 25° C., #4 spindle, 20 rpms of at least 2000 cps and at 4 times weight dilution in water a Brookfield viscosity at 25° C., #4 spindle, 20 rpms of about 40 to 400 cps which comprises approximately by weight:

(a) 14% to 25%, more preferably 15% to 22% of a $C_{14-16}$ alpha olefin sulfonate surfactant;

(b) 8% to 16%, more preferably 9% to 15% of a sodium salt of a linear alkyl benzene sulfonate surfactant wherein the weight ratio of olefin sulfonate surfactant to the linear alkyl benzene sulfonate is about 3:1 to 1:1;

(c) 2% to 5% of an alkaline earth metal salt or an alkali metal salt;

(d) 1 % to 8%, more preferably 2% to 7% of an amine oxide surfactant;

(e) 55% to 75% of water wherein the composition at 25° C., #4 spindle, 20 rpms, has a Brookfield viscosity of at least 2000 cps and at 4 times weight dilution in water has a Brookfield viscosity, 25° C., #4 spindle, 20 rpms of about 40 to about 400 cps.

A linear alkyl benzene sulfonates containing from 10 to 16 carbon atoms in the alkyl group is used in the instant compositions wherein the alkyl benzene sulfonates have a high content of 3- (or higher) phenyl isomers and a correspondingly low content (well below 50%) of 2- (or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position.

This sulfonate surfactant is preferably a sodium salt of a $C_{10}$–$C_{16}$ linear alkyl benzene sulfonate used at a concentration of about 8 wt. % to about 16 wt. %, more preferably about 9 wt. % to about 15 wt. % in the instant compositions.

The present invention also contains 14 wt. % to 25 wt. %, more preferably 15 wt. % to 22 wt. % of an alpha olefin sulfonates, including long-chain alkene sulfonates, long-chain hydroxyalkane sulfonates or mixtures of alkene sulfonates and hydroxyalkane sulfonates. These alpha olefin sulfonate surfactants may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sulfones and alkene sulfonic acids which is then treated to convert the sulfones to sulfonates. Preferred alpha olefin sulfonates contain from 14 to 16 carbon atoms in the R alkyl group and are obtained by sulfonating an a-olefin.

The amine oxides are used in the instant compositions at a concentration of 1 wt. % to 8 wt. %, more preferably 2 wt. % to 7 wt. % and are depicted by the formula:

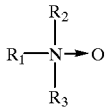

wherein $R_1$ is a $C_{10}$–$C_{18}$ a linear or branched chain alkyl group, $R_2$ is a $C_1$–$C_{16}$ linear alkyl group and $R_3$ is a $C_1$–$C_{16}$ linear alkyl group, or the amido radical:

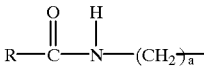

wherein R is an alkyl group having about 9 to 19 carbon atoms and a is the integer 1 to 4: $R_2$ and $R_3$ are each alkyl groups having 1 to 3 carbons and preferably 1 carbon. A preferred amine oxide is cocoamido propyl dimethyl amine oxide.

The alkaline earth metal salt or alkali metal salt used at a concentration of about 2 wt. % to about 5 wt. % is selected from the group consisting of magnesium chloride, sodium chloride, sodium bromide, potassium chloride and potassium bromide and mixtures thereof.

The instant formulas explicitly exclude alkali metal silicates and alkali metal builders such as alkali metal polyphosphates, alkali metal carbonates, alkali metal phosphonates and alkali metal citrates because these materials, if used in the instant composition, would cause the composition to have a high pH as well as leaving residue on the surface being cleaned. The instant compositions are not microemulsion compositions and to prevent the formation of a microemulsion the composition does not contain more than 0.2 wt. % of a perfume, essential oil or water insoluble hydrocarbon or water insoluble organic compound. The final essential ingredient in the inventive compositions having improved interfacial tension properties is water.

In final form, the instant compositions exhibit stability at reduced and increased temperatures. More specifically, such compositions remain clear and stable in the range of 5° C. to 50° C., especially 10° C. to 43° C. The instant compositions have a light transmission of at least 95%. Such compositions exhibit a pH of 5 to 8. The instant compositions have a minimum foam height of 110 mIs after 55 rotation at 40° C. as measured by the foam volume test using 0.75 grams of the composition per liter of water and 1 gram of corn oil per liter of water having a hardness of 300 ppm.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following composition in wt. % was prepared by simple mixing procedure at 25° C.:

| | A | B | C |
|---|---|---|---|
| Alpha olefin sulfonate | 19 | 20 | 19 |
| Sodium linear alkyl benzene sulfonate | 11 | 12 | 11 |
| Cocoamido propyl dimethyl amine oxide | 5 | 3 | 5 |
| Magnesium chloride | 3.5 | 3.5 | 3.0 |
| Water | Bal. | Bal. | Bal. |
| Brookfield viscosity 25° C., 20 rpm, #4 spindle, cps | | | |
| No dilution | 5331 | 6695 | 12210 |
| 4:1 wt. dilution with water | 227 | 49 | 67 |

The following composition were made in wt. %

| | A | B | C | D | E |
|---|---|---|---|---|---|
| Alpha olefin sulfonate | 20 | 17 | 17 | 14 | 14 |
| Sodium linear alkyl benzene sulfonate | 12 | 12 | 12 | 15 | 12 |
| Cocoamido propyl dimethyl amine oxide | 3 | 6 | 6 | 6 | 9 |
| Magnesium chloride | 2.5 | 2.5 | 2 | 2 | 2 |
| Water | Bal. | Bal. | Bal. | Bal. | Bal. |
| Brookfield viscosity, 25° C., 20 rpms, #4 spindle, cps | | | | | |
| Nodilution | >3000 | >3000 | >3000 | >3000 | >3000 |
| 3:1 weight dilution water | 320 | | 220 | 570 | |
| 4:1 weight dilution water | | 280 | | | 210 |

What is claimed:

1. A clear thickened, cleaning composition which comprises approximately by weight:

(a) 14% to 25% of an alpha olefin sulfonate surfactant;

(b) 8% to 16% of a sodium salt of a $C_8$–$C_{16}$ alkylbenzene sulfonate;

(c) 1 % to 8% of cocoamido propyl dimethyl amine oxide;

(d) 2% to 5% of a metal salt selected from the group consisting of magnesium chloride, sodium chloride, sodium bromide, potassium chloride, potassium bromide, and mixtures thereof; and (e) 55% to 75% of water, wherein the composition does not contain acetic acid, hydrotrope, betaine surfactant, glucamide surfactant, alkyl polyglucoside surfactant, silicas, abrasives, alkali metal carbonates, polymeric material, alkaline earth metal carbonates, alkyl glycine surfactant, cyclic imidinium surfactant, low molecular weight mono- or di-glucoside, alkali metal polyphosphates, alkali metal phosphonates, alkali metal citrates, more than 0.2 wt % of a perfume, essential oil, water insoluble hydrocarbon, water insoluble organic compound, and more than 3 wt % of a fatty acid or salt thereof; the composition has a pH of 5 to 8, and the composition has a Brookfield viscosity at 25° C., #4 spindle, 20 rpms of at least 2000 cps and the composition when diluted with 4 parts by weight of water to 1 part by weight of the composition has a Brookfield viscosity at 25° C., #4 spindle, 20 rpms of about 40 cps to about 400 cps.

2. The composition of claim 1, wherein said alpha olefin sulfonate is a sodium salt of a $C_{14-16}$ alpha olefin sulfonate.

* * * * *